US010256531B1

(12) United States Patent
Bhattacharyya et al.

(10) Patent No.: US 10,256,531 B1
(45) Date of Patent: Apr. 9, 2019

(54) FOLDED HORN FOR HIGH POWER ANTENNA ELEMENT

(71) Applicant: LOCKHEED MARTIN CORPORATION, Bethesda, MD (US)

(72) Inventors: Arun Kumar Bhattacharyya, Littleton, CO (US); Thomas Henry Hand, Littleton, CO (US); Adam Matthew Koontz, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 15/623,329

(22) Filed: Jun. 14, 2017

Related U.S. Application Data

(60) Provisional application No. 62/351,184, filed on Jun. 16, 2016.

(51) Int. Cl.

| | |
|---|---|
| ***H01Q 13/02*** | (2006.01) |
| ***H01Q 1/28*** | (2006.01) |
| ***H01Q 13/06*** | (2006.01) |
| ***H01Q 21/22*** | (2006.01) |
| ***H01Q 15/14*** | (2006.01) |

(52) U.S. Cl.
CPC ..... *H01Q 1/288* (2013.01); *H01Q 13/02* (2013.01); *H01Q 13/0208* (2013.01); *H01Q 13/0216* (2013.01); *H01Q 13/06* (2013.01); *H01Q 15/14* (2013.01); *H01Q 21/22* (2013.01)

(58) Field of Classification Search
CPC . H01Q 13/02; H01Q 13/0208; H01Q 13/0216
See application file for complete search history.

(56) References Cited

U.S. PATENT DOCUMENTS

| | | | | |
|---|---|---|---|---|
| 4,040,061 | A * | 8/1977 | Roberts | H01P 1/162 333/251 |
| 5,486,839 | A * | 1/1996 | Rodeffer | H01Q 13/0208 343/772 |
| 2008/0068275 | A1* | 3/2008 | Huang | H01Q 13/0266 343/786 |
| 2009/0027290 | A1* | 1/2009 | Hatazawa | H01P 1/042 343/786 |

* cited by examiner

*Primary Examiner* — Hoang V Nguyen
(74) *Attorney, Agent, or Firm* — Morgan, Lewis & Bockius LLP

(57) ABSTRACT

A horn having folded axial corrugations is provided. The horn includes folded axial corrugations for a compact, low-profile, high-efficiency, and high power handling performance. The folded axial corrugations may include a plurality of grooves that are symmetric about a central axis, each groove including an axial portion that extends in a direction parallel to the central axis and a radial portion that extends from an end of the axial portion in a direction perpendicular to the central axis.

19 Claims, 9 Drawing Sheets

FOLDED HORN FOR HIGH POWER ANTENNA ELEMENT

CROSS-REFERENCES TO RELATED APPLICATIONS

This application claims priority to and the benefit of U.S. Provisional Patent Application No. 62/351,184, filed Jun. 16, 2016, which is hereby incorporated by reference in its entirety.

STATEMENT REGARDING FEDERALLY SPONSORED RESEARCH OR DEVELOPMENT

Not applicable.

FIELD

The disclosure relates in general to antennas, and in particular to, for example, without limitation, feeds for antennas.

BACKGROUND

The description provided in the background section, including without limitation, any problems, features, solutions or information, should not be assumed to be prior art merely because it is mentioned in or associated with the background section. The background section may include information that describes one or more aspects of the subject technology.

In order to minimize the implementation cost of a phased array antenna or reflector feed assembly, the number of radiating elements is desired to be small. For a desired array gain, the number of radiating elements can be reduced by using elements with a high aperture efficiency. However, conventional high aperture efficiency radiating elements often have a bandwidth that is limited to only few percent (typically 5%).

SUMMARY

In accordance with various aspects of the subject disclosure, an antenna horn having folded axial corrugations is provided. The horn having folded axial corrugations may provide a horn antenna element or a feed horn for an antenna that is low-profile, low-cost, and high power with respect to antennas such as axially or radially corrugated antennas. The folded axially corrugated horn may be implemented in a phased array antenna or a reflector feed assembly.

In accordance with various aspects of the subject disclosure, an antenna is provided that includes a horn having folded axial corrugations and a central axis. The folded axial corrugations include a plurality of annular wall sections that are axially spaced apart and have radially offset inner edges. The folded axial corrugations also include a plurality of cylindrical wall sections. Each of the cylindrical wall sections extends perpendicularly from the inner edge of a corresponding annular wall section.

In accordance with other aspects of the subject disclosure, an antenna is provided that includes a horn having folded axial corrugations and a central axis. The folded axial corrugations include a plurality of grooves that are symmetric about the central axis, each groove including an axial portion that extends in a direction parallel to the central axis and a radial portion that extends from an end of the axial portion in a direction perpendicular to the central axis.

In accordance with other aspects of the subject disclosure, a satellite is provided that includes at least one horn having folded axial corrugations and a central axis. The folded axial corrugations of the at least one horn include a plurality of annular wall sections that are axially spaced apart and have radially offset inner edges. The folded axial corrugations of the at least one folded axially corrugated horn also include a plurality of cylindrical wall sections. Each of the cylindrical wall sections extends perpendicularly from the inner edge of a corresponding annular wall section.

It is to be understood that both the foregoing general description and the following detailed description are exemplary and explanatory and are intended to provide further explanation of the subject technology as claimed. It is also to be understood that other aspects may be utilized and changes may be made without departing from the scope of the subject technology.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

Figure 1A:
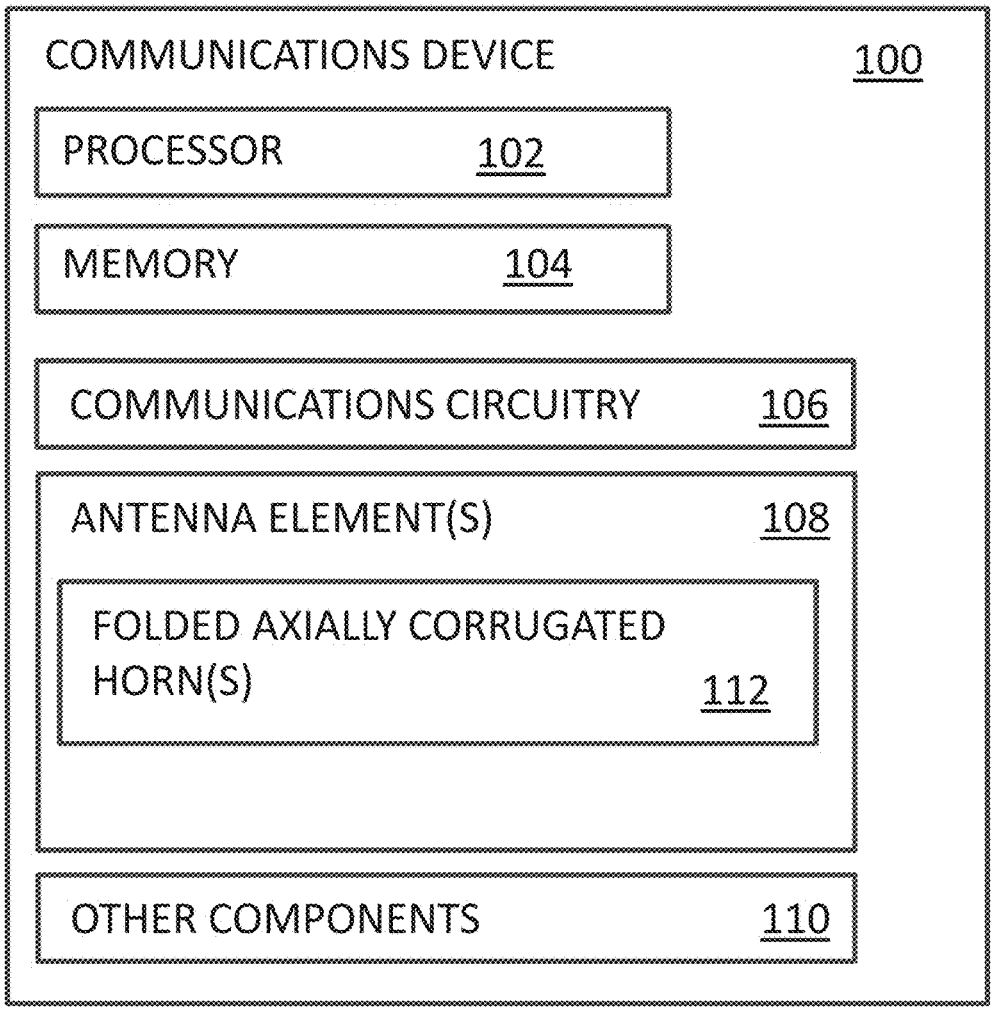
FIG. 1A illustrates a block diagram of a communications device in accordance with certain aspects of the disclosure.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element numbers for ease of understanding.

In accordance with aspects of the subject disclosure, a horn having folded axial corrugations is disclosed that provides, for example, a low-profile, low-cost, and high power antenna element.

High aperture efficiency antenna elements can include a subarray of microstrip patches, a waveguide-fed slot subarray and/or high-efficiency multimode horns. For patch and waveguide-fed slot subarrays, the bandwidth can be undesirably limited. The high-efficiency multimode horns, on the other hand, yield a wider bandwidth (e.g., 10 to 20%), but the axial length of such a horn can be undesirably large. For low-frequency applications (e.g., L and S band implementations), the axial length may cause difficulties in fitting the array or feed within an allowable volume for a particular implementation. The subject technology may provide the benefit of a low profile (e.g., low axial length) array or feed element that has a relatively high aperture efficiency over a wide operating bandwidth.

A high aperture efficiency can be obtained if the aperture field distribution is uniform. The aperture distribution of a circular waveguide carrying the dominant mode (e.g., the TE11 mode for circular waveguides) is highly tapered in one plane and moderately tapered in the orthogonal plane. As a result, the aperture efficiency of a dominant mode horn is low. The edge taper can be reduced by introducing multiple modes on the aperture with the proper amplitude and phase distributions.

A high efficiency multi-mode horn may produce the desired modes by implementing step discontinuities on the wall. The desired phase distribution is realized by adjusting the section lengths. The axial length dimension of such a horn can thus become physically large. For instance, the axial length of a multi-mode horn of aperture diameter of about two wavelengths may be about four wavelengths in order to achieve about a 90% aperture efficiency.

At a frequency of, for example, 2 GHz, the axial length of a multi-mode horn becomes about 24 inches, which may be undesirably large for many applications. The uniform aperture field can also be realized by using radial or axial corrugations instead of smooth walls. However, for a radially corrugated structure, the effective aperture area is low. As a result, the aperture efficiency becomes low. An axially corrugated horn structure, on the other hand, has a larger effective aperture area; hence, the aperture efficiency can be higher. However, both radially and axially corrugated horn structures can have an undesirably large axial length.

In accordance with some aspects of the subject disclosure, a horn is provided that includes folded axial corrugations and provides improvements, even over an axially corrugated horn. For example, the axial length of the horn having folded axial corrugations is shorter than an axially corrugated horn. The shorter axial length is accomplished by providing axial grooves with a fold (e.g., a 90° bend) in the radial direction. The additional reactance caused by the deformation (e.g., the bend) in the axial groove is compensated by adjusting the width and length of the groove. Folded axial grooves can provide a substantial horn axial length reduction. For instance, the axial length of a folded axially corrugated horn can be, for example, about eight inches at L-band, with electrical characteristics that are comparable to that of an axial corrugated horn counterpart without folds and with much longer axial length.

In various aspects, the subject technology provides a compact, low-profile horn with a high efficiency. The horn having folded axial corrugations (sometimes referred to herein as a folded axially corrugated horn), described in further detail hereinafter, may provide one or more benefits relative to existing radiating structures. For example, the folded axially corrugated horn, described in further detail hereinafter, may provide a significantly lower axial length dimension than other horn structures with comparable aperture efficiency. As another example, the folded axially corrugated horn, described in further detail hereinafter, may provide a bandwidth that is wider than other low profile radiating elements, such as patch elements. As another example, the folded axially corrugated horn, described in further detail hereinafter, may provide a circularly symmetrical configuration that allows production using additive manufacturing operations (e.g., 3D printing operations) to generate a single piece (e.g., monolithic) horn. This may reduce not only the implementation cost, but may also reduce or eliminate risks from, for example, Passive Inter-Modulation (PIM) effects for high power applications.

FIG. 1A illustrates a block diagram of an exemplary communications device having a horn 112 that include folded axial corrugations. As shown in FIG. 1A, communications device 100 includes one or more antennas such as antenna 108. One or more of antennas 108 may include a folded axially corrugated horn 112. The folded axially corrugated horn 112 may be the radiating or receiving portion of the antenna and/or the folded axially corrugated horn 112 may form a feed horn for a separate radiating and/or receiving antenna and/or a reflector. Communications device 100 may include a single antenna 108 or multiple antennas 108 (e.g., an array of antennas or multiple individually controlled antennas), each with or without an associated folded axially corrugated horn 112. The horn 112 having folded axial corrugations may be implemented as a direct radiator, in a direct radiator array, as a single feed for a reflector, or one of an array of reflector antenna feeds.

Communications device 100 may be a fixed device such as a television antenna that is mounted to a structure (e.g., a building, a communications tower, or the ground), a mobile device such as a vehicle-mounted communications device (e.g., a communications device disposed on a car, truck, tank, boat, ship, submarine, or aircraft), or a space-based device such as a satellite (e.g., a Global Positioning System (GPS) satellite).

As shown in FIG. 1A, communications device 100 may include other components 110. Other components 110 may be specific components for a specific device such as spacecraft components (e.g., a spacecraft body to which one or more folded axially corrugated horns are attached, solar panels or other power sources) for a spacecraft such as a satellite, vehicle components (e.g., wheels, rudders, and/or propulsion systems) for a vehicle, handheld device components such as a housing, or other suitable components as desired. Other components 110 may include user interface components such as a visual display or a speaker (as examples).

Communications device 100 includes communications circuitry 106 that operates antenna(s) 108 with associated folded axially corrugated horns 112. Communications circuitry 106 may include one or more feed elements such as feedlines that provide signals to one or more folded axially corrugated horns, that cause the horn to radiate a desired signal. The feed elements may also, or alternatively, transfer signals received by folded axially corrugated horn 112 to, for example, processor 102 for processing. Communications circuitry 106 may also include signal processing circuitry such as one or more amplifiers, filters, analog-to-digital (ADC) converters that convert analog signals from folded axially corrugated horn 112 to digital signals for further processing and/or transmission, digital-to-analog converters (DACs) that convert digital signals to analog signals for transmission by folded axially corrugated horn 112, oscillators, mixers, or the like as would be understood by one skilled in the art.

Communications circuitry 106 may be coupled to external broadcasting or receiving systems and/or to internal computing circuitry such as processor 102 and/or memory 104. In some configurations, processor 102 may cause communications circuitry 106 to provide a desired feedline signal to folded axially corrugated horn 112 to cause folded axially corrugated horn 112 to radiate a desired signal. In some configurations, processor 102 may receive a signal from folded axially corrugated horn 112 via communications circuitry 106 and further process signals received from folded axially corrugated horn 112 (e.g., to encode or decode the received signals, to generate image data or audio data from the received signals, or to determine a location of a transmitting device relative to communications device 100). Processor 102 may interact with memory 104 to store information determined from signals received at folded axially corrugated horn 112 or to generate signals to be transmitted by folded axially corrugated horn 112.

For example, memory 104 may store data generated based on signals received at folded axially corrugated horn 112, data to be transmitted by folded axially corrugated horn 112, and/or instructions that, when executed by processor 102 cause processor 102 to operate communications circuitry 106 and folded axially corrugated horn 112 and/or process data received from communications circuitry 106 and folded axially corrugated horn 112.

Processor 102 may include one or more microprocessors, multi-core processors, and/or one or more integrated circuits, such as application specific integrated circuits (ASICs) or field programmable gate arrays (FPGAs) that load and execute sequences of instructions, software modules, etc. Processor 102 may execute instructions stored in memory 104. In some implementations, such integrated circuits execute instructions that are stored on the circuit itself.

Memory 104 may include computer-readable media such as RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra-density optical discs, any other optical or magnetic media, and floppy disks. Memory 104 can store sets of instructions/code that are executable by processor 102 including sets of instructions/code that implement the communications processes described herein. Examples of computer programs or computer code include machine code, such as is produced by a compiler, and files including higher-level code that are executed by a computer, an electronic component, or a microprocessor using an interpreter.

Figures 1B, 1C:
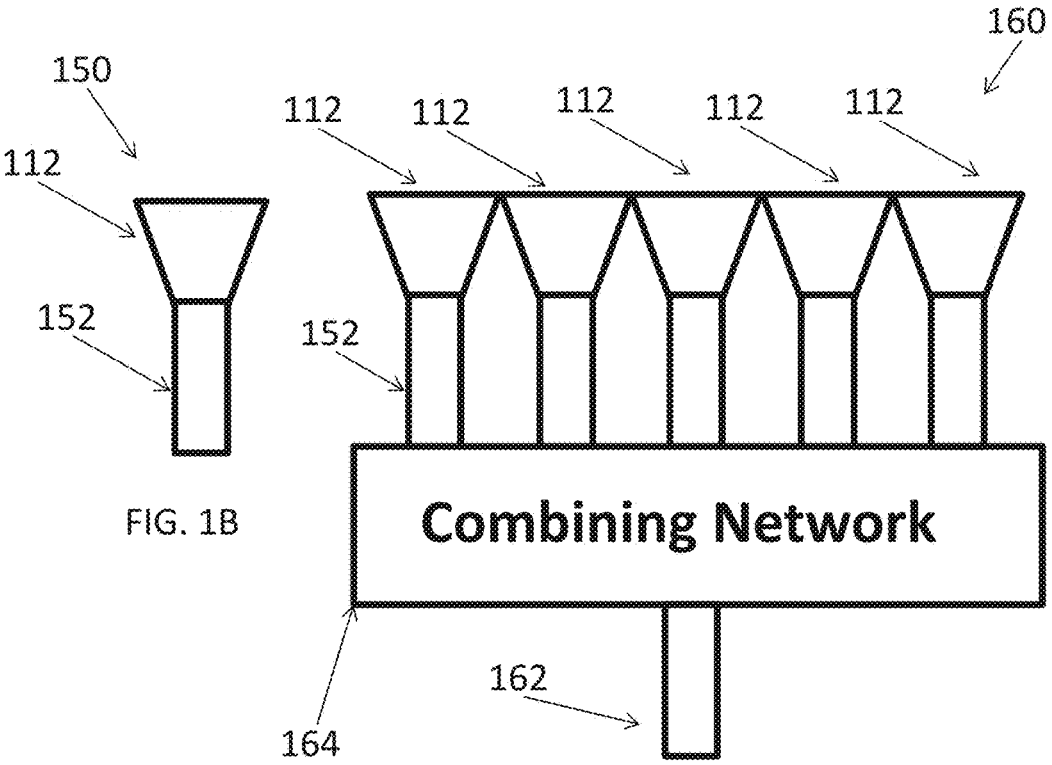
FIG. 1B illustrates a schematic diagram of a direct radiating element with a horn with folded axial corrugations in accordance with certain aspects of the disclosure.
FIG. 1C illustrates a schematic diagram of an array of direct radiating elements, each with a horn with folded axial corrugations in accordance with certain aspects of the disclosure.

FIGS. 1B, 1C, 1D, and 1E show various implementations of antennas having one or more horns with folded axial corrugations, that may be implemented in a system or device such as communications device 100. In the example of FIG. 1B, a horn 112 having folded axial corrugations (corrugations not visible in FIG. 1B) is implemented as a single element direct radiator. As shown, horn 112 may be fed by a waveguide feed 152.

In the example of FIG. 1C, a direct radiating array 160 is shown that includes multiple horns 112, each having folded axial corrugations (corrugations not visible in FIG. 1C). As shown in FIG. 1C, each horn 112 may be coupled by an associated waveguide 152 to a combining network 164 that directs the signals associated with each horn 112 appropriately between that horn and a feed 162 (e.g., a common waveguide feed for the array). In the examples of FIGS. 1B and 1C, the horns 112 are implemented as direct radiators. However, in other examples, one or more horns 112 may be implemented as reflector feeds.

Figure 1D:
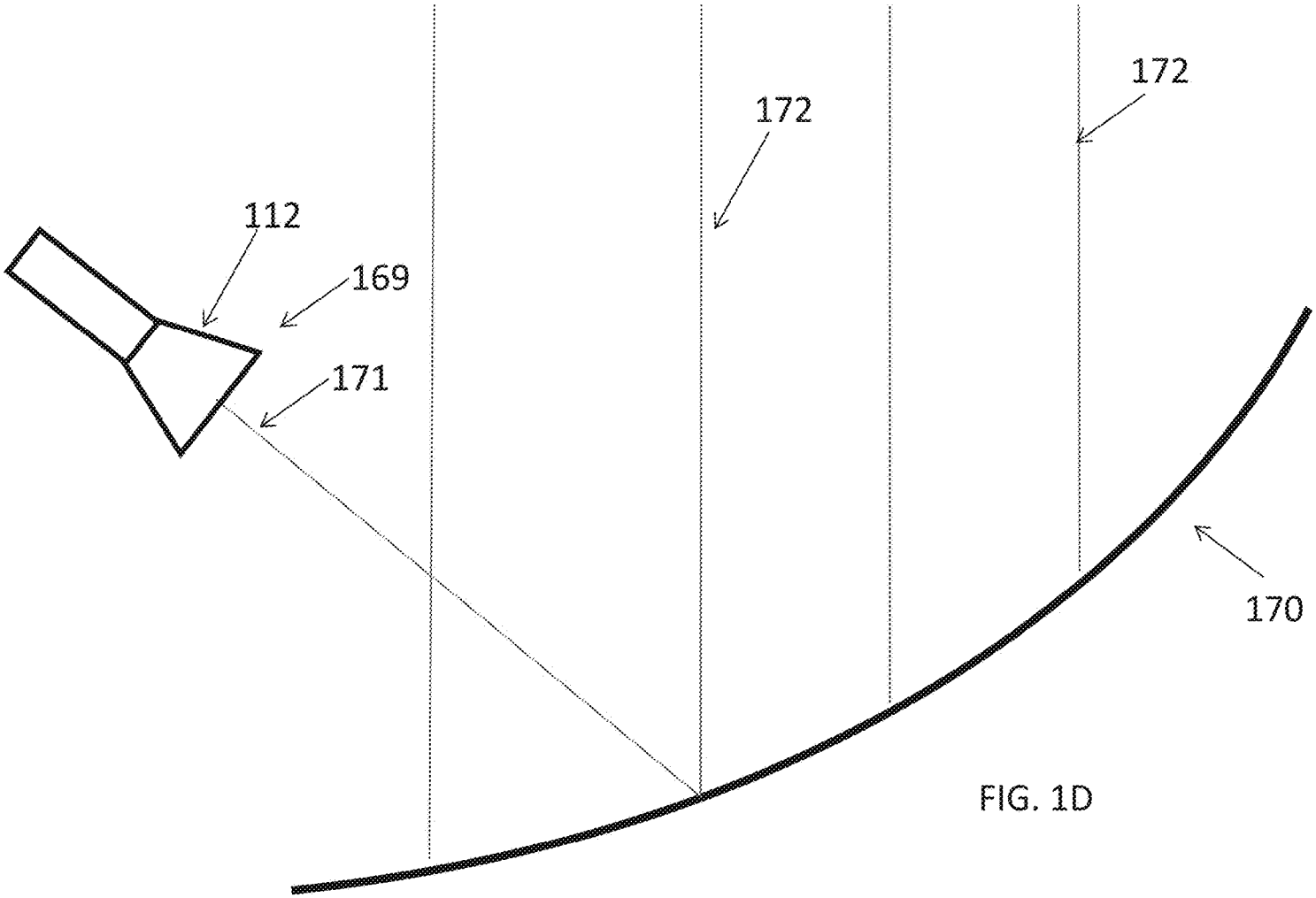
FIG. 1D illustrates a schematic diagram of a reflector that is fed by a horn with folded axial corrugations in accordance with certain aspects of the disclosure.
Figure 1E:
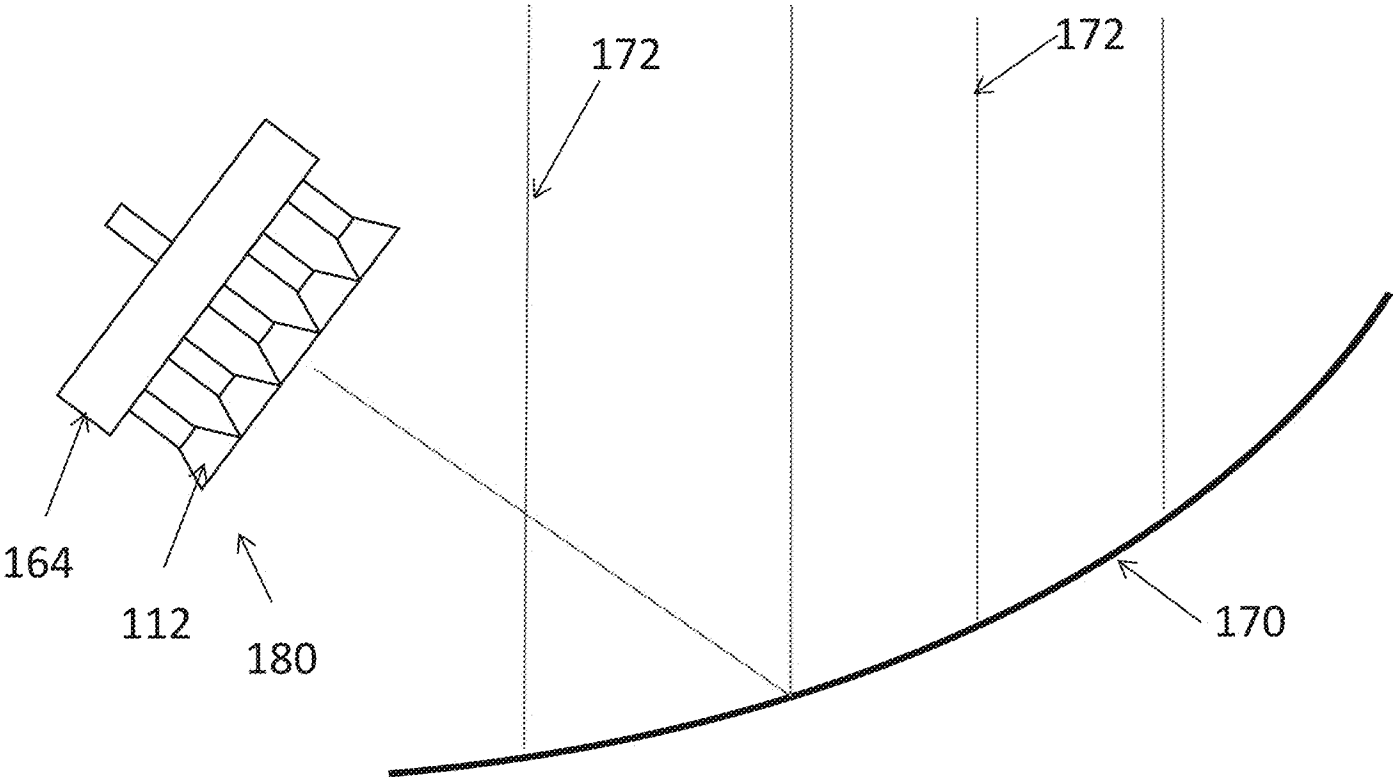
FIG. 1E illustrates a schematic diagram of a reflector that is fed by an array of horns each with folded axial corrugations in accordance with certain aspects of the disclosure.

In the example of FIG. 1D, a single feed 169 having a horn 112 with folded axial corrugations (corrugations not visible in FIG. 1D) is provided as a feed for reflector 170. Reflector 170 redirects radiation 171 from horn 112 to form output plane waves 172 (or vice versa for a receiver). In the example of FIG. 1E, reflector 170 is fed by a feed cluster 180 having an array of horns 112, each having folded axial corrugations (corrugations not visible in FIG. 1E) and each communicatively coupled to combining network 164.

Figure 2:
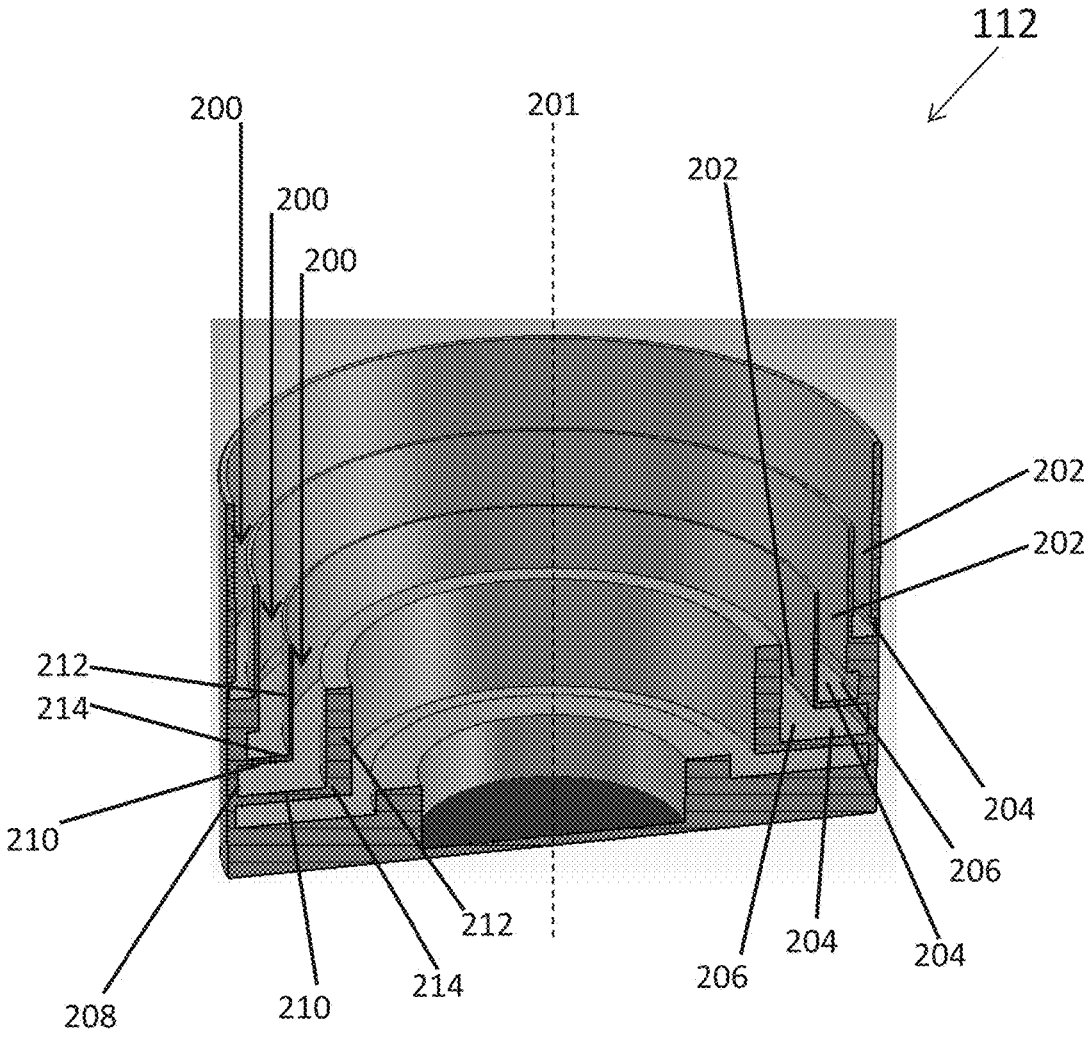
FIG. 2 illustrates a cross-sectional perspective view of a horn with folded axial corrugations in accordance with certain aspects of the disclosure.

For simplicity, the folded axial corrugations of horns 112 are not visible in the schematic diagrams of FIGS. 1B, 1C, 1D, and 1E. An exemplary implementation of a horn 112 showing the folded axial corrugations of the horn is illustrated in FIG. 2. As shown in the cross-sectional perspective view of FIG. 2, folded axially corrugated horn 112 may be implemented with one or more axial grooves 200 (e.g., grooves that are symmetric about the axis 201 of horn 112). Each axial groove 200 includes a bend 206 between an axial portion 202 of the groove and a radial portion 204 of the groove. Axial portion 202 of each groove has, in cross-section, an elongated dimension that extends in a direction parallel to the axis 201 of the horn. Radial portion 204 of each groove has, in cross-section, an elongated dimension that runs perpendicular to the axis 201 of the horn and perpendicular to the axial portion 202 of that groove.

Each of portions 202 and 204 is symmetric about axis 201 of horn 112. Radial portions 204 of different grooves are parallel to each other and axially offset from each other. Axial portions 202 of different grooves are parallel to each other and radially offset from each other. Bends 206 of different grooves are axially and radially offset from each other.

Each groove 200 is defined by a pair of partially opposing radial walls 210 and a pair of partially opposing axial walls 212. Each axial wall 212 extends from a radially innermost end of an associated radial wall 210. Of the opposing radial walls 210 that define a particular groove 200, an axially outermost wall 210 has a radial length that is shorter than the radial length of the opposing wall 210. In this way, the fold or bend 206 in each groove is formed by opposing bends 214 at the intersection of each axial wall 212 and its associated radial wall 210. Of the opposing axial walls 212 that define a particular groove 200, the radially outermost wall 212 has an axial length that is longer than, and/or extends axially further outward than, the axial dimension of the opposing wall 212.

Axial walls 212 each form a cylindrical structure around axis 201. The cylindrical structures formed by axial walls 212 form a series of radially expanding axially offset cylinders. Radial walls 210 each form an annulus around axis 201. The annular structures formed by radial walls 210 form a series of axially offset annular plates, axially increasing in inner diameter, and axially decreasing in annular width moving outward along axis 201. In this way, the desired axially corrugated structure is formed.

Annular wall sections 210 are axially spaced apart and have radially offset inner edges. Each of cylindrical wall sections 212 extends perpendicularly from the inner edge of a corresponding annular wall section 210. Cylindrical wall sections 212 are radially spaced apart and axially offset. In the example of FIG. 2, each cylindrical wall section is rotationally symmetric about the central axis. In the example of FIG. 2, each of the annular wall sections is rotationally symmetric about the central axis.

As shown in FIG. 2, each of annular wall sections 210 has an annular width and an axial position along the central axis 201. The annular width of an annular wall section 210 with a first axial position along the central axis is smaller than the annular width of another annular wall section 210 with a second axial position along the central axis when the first axial position is axially outward of the second axial position.

In the example of FIG. 2, axial portion 202 of each groove 200 forms a cylindrical groove about the central axis 201. In this example, adjacent cylindrical grooves 202 are parallel and axially offset. Cylindrical grooves 202 have increasing radii (e.g., the radial distance from central axis 201 to the radial center of the groove) with increasingly outward position along the central axis. In the example of FIG. 2, radial portions 204 of the grooves have radial widths that monotonically decrease with an outward axial position, of that radial portion, along the central axis.

As shown, the pairs of partially opposing radial walls 210, the pairs of partially opposing axial walls 212, and the folded axial grooves 200 defined therebetween form folded axial corrugations in horn 112 (e.g., in the surface of horn 112).

Radial portion 204 of each groove 200 has an outer edge that is defined by a cylindrical outer wall 208. In the example of FIG. 2, each radial wall 210 and corresponding axial wall 212 are contiguously formed, filled structures, contiguous with the monolithic overall structure of a monolithic folded axially corrugated horn 112, and the cylindrical outer wall 208 of each groove 200 is formed by a cutout in the monolithic overall structure of horn 112. To form a folded axially corrugated horn as shown in the example of FIG. 2, in one example, an additive manufacturing process (sometimes referred to as a 3D printing processes) may be performed to print the monolithic structure having the features as shown from a printable conductive material (e.g., aluminum, an aluminum alloy, or other suitable conductive printable material). However, this is merely illustrative. In other examples, some of which are discussed in further detail hereinafter, a structure of the type shown in FIG. 2 may be formed using subtractive machining and/or other monolithic or non-monolithic implementations can be provided.

Figure 3:
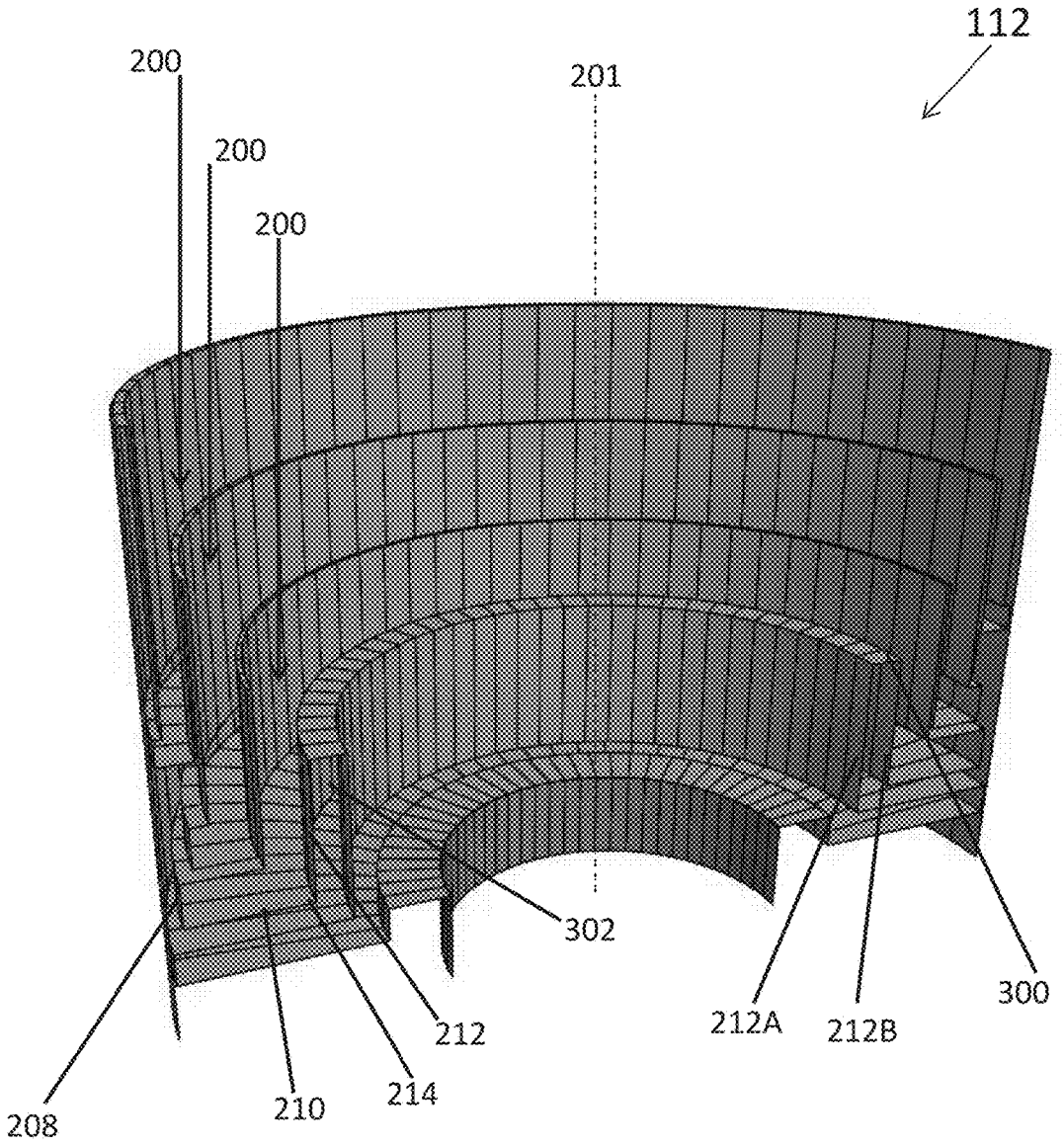
FIG. 3 illustrates a cross-sectional perspective view of another horn with folded axial corrugations in accordance with certain aspects of the disclosure.

For example, FIG. 3 shows one alternative implementation of a horn having folded axial corrugations. In the example of FIG. 3, folded axially corrugated horn 112 is formed with unfilled walls 210 and 212. As shown, each of walls 212 may be formed from inner and outer walls 212A and 212B that are separated by a gap 302 and connected at an axially outermost end by top wall 300.

Figure 4:
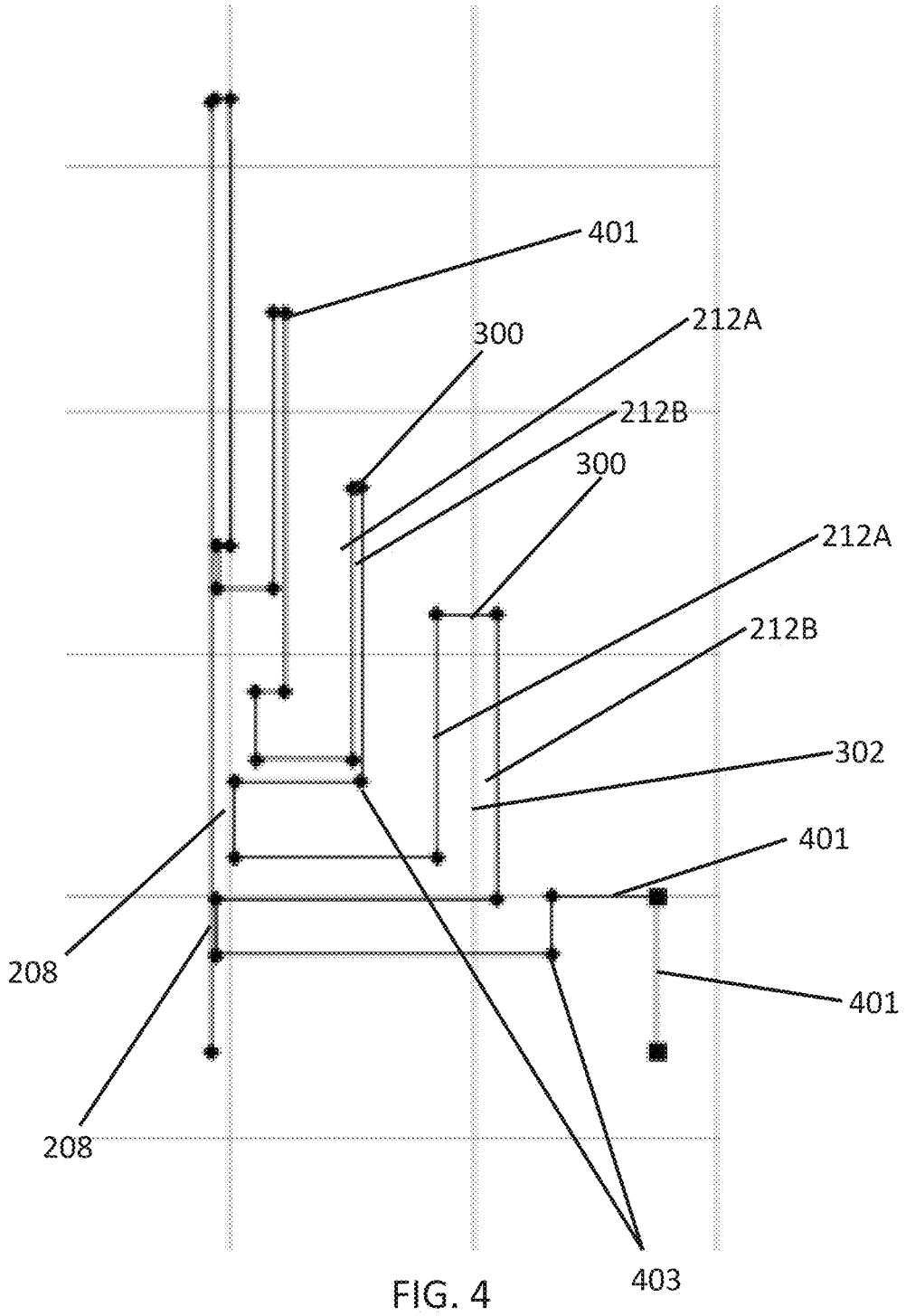
FIG. 4 illustrates a cross-sectional profile of a horn with folded axial corrugations in accordance with certain aspects of the disclosure.

In the example of FIG. 3, inner and outer axial walls 212A and 212B are coupled to radial walls 210 that define different grooves 200. In the example of FIG. 3, radial walls 210, inner and outer axial walls 212A and 212B and top walls 300 that define grooves 200 may be formed by one or more bends in one or more contiguous conductive strips or may be formed by other additive or subtractive manufacturing operations. FIG. 4 shows a cross-sectional profile of one side of a folded axially corrugated horn in the implementation of FIG. 3. As shown in FIG. 4, in cross-sectional profile, folded axially corrugated horn 112 of FIG. 3 is formed by a plurality of thin planar portions 401 joined by bends 403. Bends 403 may be formed by folds in a contiguous strip of material, may be formed by bends in a contiguous additive manufactured structure, or may be formed by joints between separate cross-sectionally planar (e.g., cylindrical or annular) structures.

Figure 5:
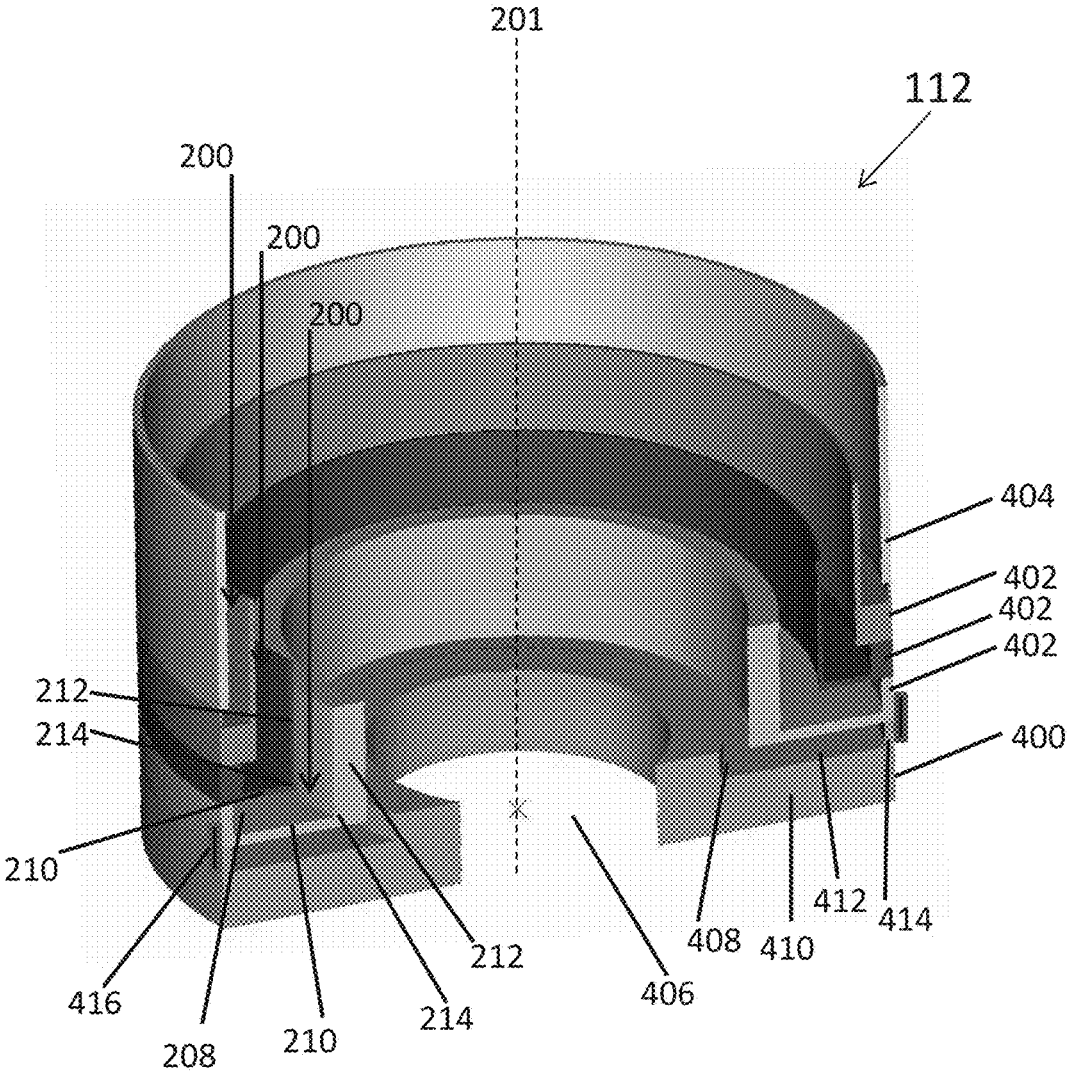
FIG. 5 illustrates a cross-sectional perspective view of another horn with folded axial corrugations in accordance with certain aspects of the disclosure.

However, the examples of FIGS. 2-4 are merely illustrative. FIG. 5 shows another implementation of a horn having folded axial corrugations formed from multiple sections (e.g., flange-coupled sections). In the example of FIG. 5, folded axially corrugated horn 112 is formed from a base section 400, a top section 404, and intermediate sections 402 disposed between the base section and the top section.

As shown in FIG. 5, top section 404 may be a substantially cylindrical structure having a central opening centered on axis 201 of horn 112. Base section 400 may have a thick radial annulus 410 that extends from an outer surface of horn 112 to define an inner cylindrical opening 406. Radial annulus 410 may include a recess 412 on an axially outermost surface. Recess 412 defines cylindrical sidewalls 408 and 414 that, together with the axially outermost surface of annulus 410 in the recess, define a first side of a radial portion of an axially innermost groove 200.

Sections 400, 402, and 404 may be joined by exterior flanges such as flange 416 attached to each section across an inter-section interface. Flanges 416 may be radially discrete structures or may be cylindrical structures that extend around the outer wall of horn 112 (e.g., the circular outer circumference of horn 112 in circularly symmetric implementations of horn 112). Sections 400, 402, and 404 may be individually manufactured (e.g., printed, or machined) before being coupled together using flanges 416.

Figure 6:
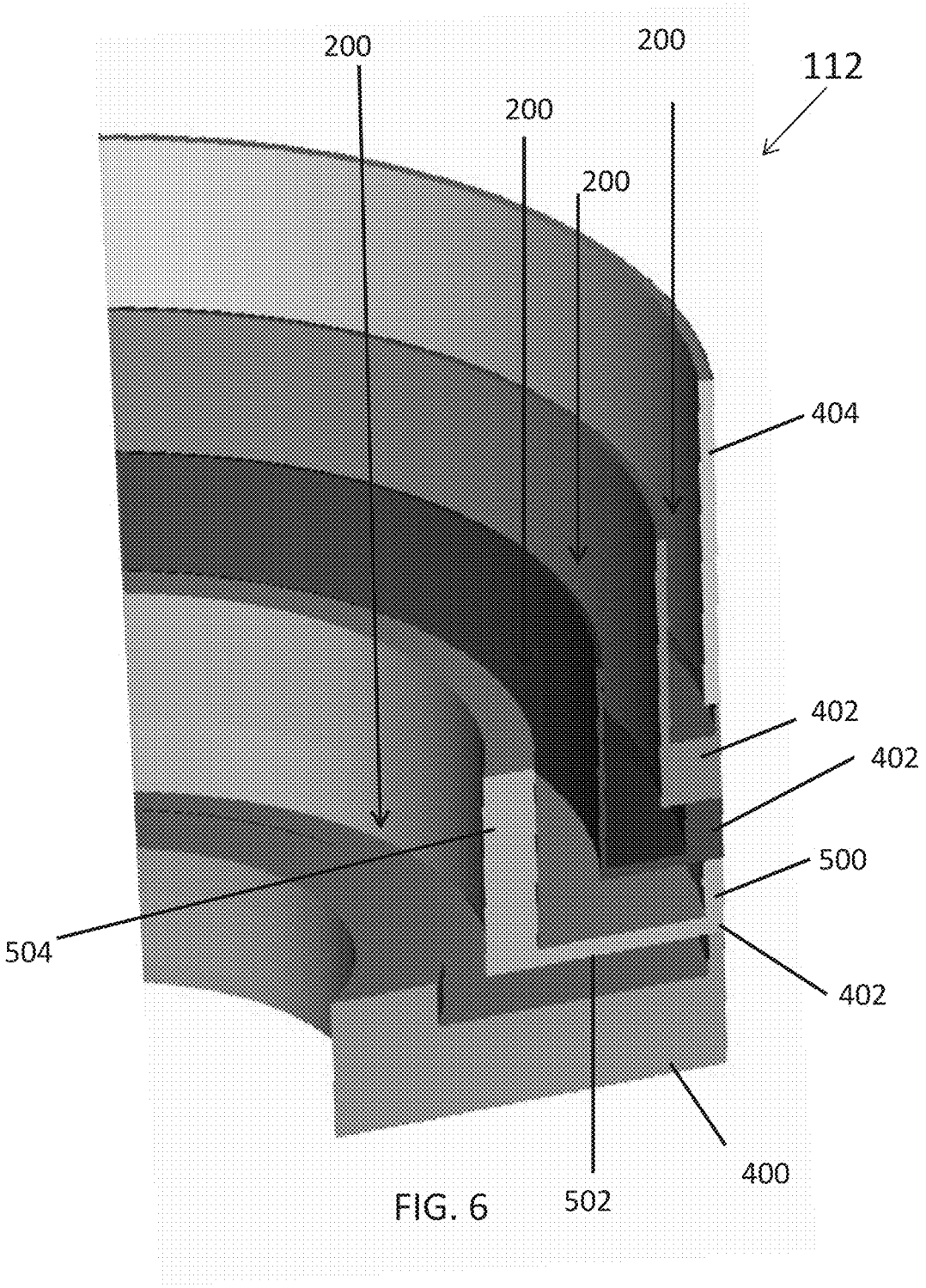
FIG. 6 illustrates an enlarged cross-sectional perspective view of the horn of FIG. 5 in accordance with certain aspects of the disclosure.

FIG. 6 shows an enlarged view of a portion of the folded axially corrugated horn of FIG. 5 in which details of each intermediate section 402 can be more clearly seen. As shown in FIG. 6, each intermediate section 402 may include a cylindrical outer wall 500 (e.g., that forms an outer wall 208 of a corresponding groove), a cylindrical inner wall 504 (e.g., that defines one side of a corresponding groove 200), and an annular wall 502 that extends from the cylindrical inner wall 504 to the cylindrical outer wall 500 of that section. As shown, cylindrical inner wall 504 of each section has an axial length (e.g., parallel to axis 201) that is longer than the axial length of the cylindrical outer wall 500 of that section. The cylindrical outer walls 500 of sections 402, together with the cylindrical outer walls of base section 402 and upper section 404, form an outer surface of folded axially corrugated horn 112. Sections 400, 402, and 404 (and/or some or all of the structures described in connection with FIGS. 2-4) may be formed from, for example, a conductive material such as aluminum or an aluminum alloy such as a 6061-T6 aluminum alloy.

Folded axially corrugated horn 112, in the various example implementations described herein may be an L-band horn configured to receive and/or transmit electromagnetic signals with frequency bands centered at, for example, 1.227 and 1.575 GHz with an efficiency of, for example, greater than 80 percent or 90 percent, and with an axial horn height of less than, for example, nine inches (e.g., less than or equal to 8.8 inches or less than or equal to 8.2 inches).

It should be appreciated that, although the examples of the folded axially corrugated horn of FIGS. 2-5 have a circular aperture (and are circularly symmetric about axis 201), other shaped apertures (e.g., a hexagonal aperture) and other associated rotational symmetries about axis 201 are contemplated for sections 400, 402, and 404, grooves 200, radial portions 204 and axial portions 202, axial walls 212 and the inner and/or outer edges of annular walls 210.

Various aspects of the subject technology may be implemented in, for example, space-based antenna systems. Various aspects of the subject technology may be implemented in, for example, communications systems, radar systems, and/or sensors. Various aspects disclosed herein relate to radiating elements, low cost antenna systems, low profile antenna systems, high power antenna systems, and/or high efficiency antenna systems.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these aspects will be readily apparent to those skilled in the art, and generic principles defined herein may be applied to other aspects. Thus, many changes and modifications may be made to the subject technology, by one having ordinary skill in the art, without departing from the scope of the subject technology.

It is understood that the specific order or hierarchy of steps in the processes disclosed is an illustration of exemplifying approaches. Based upon design preferences, it is understood that the specific order or hierarchy of steps in the processes may be rearranged. Some of the steps may be performed simultaneously.

It is noted that dimensional aspects (e.g., spacecraft height, antenna diameter, horn frequency, and horn height) provided above are examples and that other values for the dimensions can be utilized in accordance with one or more implementations. Furthermore, the dimensional aspects provided above are generally nominal values. As would be appreciated by a person skilled in the art, each dimensional aspect, such as radius, has a tolerance associated with the dimensional aspect.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

A reference to an element in the singular is not intended to mean "one and only one" unless specifically stated, but rather "one or more". The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for". Furthermore, to the extent that the term "include", "have", or the like is used in the description or the claims, such term is intended to be inclusive in a manner similar to the term "comprise" as "comprise" is interpreted when employed as a transitional word in a claim.

What is claimed is:

1. An antenna, comprising:

a horn with folded axial corrugations and a central axis, the folded axial corrugations comprising:

a plurality of annular wall sections that are axially spaced apart and have radially offset inner edges; and a plurality of cylindrical wall sections, wherein each of the cylindrical wall sections extends perpendicularly from the inner edge of a corresponding annular wall section, wherein the annular wall sections form a series of axially offset annular plates, axially increasing in inner diameter, and axially decreasing in annular width moving outwards along the central axis.

2. The antenna of claim 1, wherein the horn is a monolithic folded axially corrugated horn.

3. The antenna of claim 2, wherein the horn is an additive manufactured monolithic folded axially corrugated horn.

4. The antenna of claim 1, wherein the cylindrical wall sections are radially spaced apart and axially offset.

5. The antenna of claim 4, wherein each cylindrical wall section is rotationally symmetric about the central axis.

6. The antenna of claim 5, wherein each of the annular wall sections is rotationally symmetric about the central axis.

7. The antenna of claim 1, wherein the folded axial corrugations further comprise a plurality of axially symmetric grooves, each groove having a radial portion defined by opposing ones of the annular wall sections and an axial portion defined by opposing ones of the cylindrical wall sections.

8. The antenna of claim 7, wherein each of the axially symmetric grooves includes a bend between the radial portion and the axial portion.

9. The antenna of claim 1, wherein the horn is formed from a plurality of flange-coupled sections.

10. The antenna of claim 9, wherein the plurality of flange-coupled sections comprise a base section, a cylindrical top section, and a plurality of intermediate sections disposed between the base section and the cylindrical top section.

11. An antenna, comprising:

a horn having folded axial corrugations and a central axis, the folded axial corrugations comprising a plurality of grooves that are symmetric about the central axis, each groove comprising an axial portion that extends in a direction parallel to the central axis and a radial portion that extends from an end of the axial portion in a direction perpendicular to the central axis.

12. The antenna of claim 11, wherein each of the grooves is a groove in a common monolithic structure.

13. The antenna of claim 11, wherein the horn comprises a plurality of separate sections, and wherein each of the grooves is defined by wall portions of adjacent sections.

14. The antenna of claim 13, further comprising a flange on an outer surface of the horn that secures the adjacent sections.

15. The antenna of claim 11, wherein the axial portion of each groove forms a cylindrical groove about the central axis.

16. The antenna of claim 15, wherein adjacent cylindrical grooves are parallel and axially offset.

17. The antenna of claim 16, wherein the cylindrical grooves have increasing radii with increasingly outward position along the central axis.

18. The antenna of claim 11, wherein, the radial portions of the grooves have radial widths that monotonically decrease with an outward axial position, of that radial portion, along the central axis.

19. A satellite, comprising:

at least one horn having folded axial corrugations and a central axis, the folded axial corrugations of the at least one horn comprising:

a plurality of annular wall sections that are axially spaced apart and have radially offset inner edges; and a plurality of cylindrical wall sections, wherein each of the cylindrical wall sections extends perpendicularly from the inner edge of a corresponding annular wall section, wherein the annular wall sections form a series of axially offset annular plates, axially increasing in inner diameter, and axially decreasing in annular width moving outwards along the central axis.

* * * * *